US007699303B2

(12) United States Patent
Fairweather et al.

(10) Patent No.: US 7,699,303 B2
(45) Date of Patent: Apr. 20, 2010

(54) MULTIMODE STACK AND SHINGLE DOCUMENT FEEDER

(75) Inventors: James A. Fairweather, Milford, CT (US); Thomas M. Lyga, Southbury, CT (US); Theresa Bartick, Gorham, ME (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 12/389,192

(22) Filed: Feb. 19, 2009

(65) Prior Publication Data

US 2009/0152796 A1 Jun. 18, 2009

Related U.S. Application Data

(63) Continuation of application No. 11/267,003, filed on Nov. 4, 2005, now abandoned, which is a continuation-in-part of application No. 11/084,233, filed on Mar. 18, 2005, now Pat. No. 7,591,454.

(51) Int. Cl.
*B65H 3/44* (2006.01)

(52) U.S. Cl. ..... 271/9.08; 271/9.01; 271/9.07

(58) Field of Classification Search ..... 271/9.01, 271/9.07, 9.08

See application file for complete search history.

(56) References Cited

U.S. PATENT DOCUMENTS 4,033,807 A 7/1977 Neill et al.
4,037,953 A * 7/1977 Sone et al. ..... 355/45
4,053,152 A * 10/1977 Matsumoto ..... 271/9.07
4,196,898 A * 4/1980 Misawa et al. ..... 271/9.08
4,202,150 A 5/1980 Peterson
4,222,557 A 9/1980 Wu
4,538,799 A * 9/1985 Bhagwat ..... 271/9.08
4,635,922 A * 1/1987 Roetter et al. ..... 271/119
4,674,734 A 6/1987 Ibuchi
4,972,655 A 11/1990 Ogawa (Continued)

*Primary Examiner*—Patrick H Mackey
*Assistant Examiner*—Howard Sanders
(74) *Attorney, Agent, or Firm*—Steven J. Shapiro; Angelo N. Chaclas

(57) ABSTRACT

A feeder for feeding media items from a tray includes a first nudger roller and a second nudger roller. The first and the second nudger roller are moveably mounted to the feeder. The first and the second nudger rollers are in a first position when a tray of a first type is connected to said feeder the first and said second nudger rollers are in a second position when a tray of a second type is connected to said feeder. The tray of a first type may be a shingle feed tray and the tray of a second type may be a stacks feed tray. With the shingle feed tray the first position for the first and the second nudger rollers are where each nudger roller engages each media item in a shingles tray when each such media item is positioned in the shingles tray to exit the shingles tray and to be moved from the shingles tray into said feeder. With the stacks feed tray the second position for the first and the second nudger rollers are where the first nudger roller is positioned out of engagement with media items in a stacks tray and the second nudger rollers is positioned to each engage each media item in the stacks tray when each such media item is positioned in said stacks tray to exit the stacks tray and to be moved from the stacks tray into said feeder.

16 Claims, 9 Drawing Sheets

U.S. PATENT DOCUMENTS 4,986,522 A 1/1991 Paulson
5,117,610 A 6/1992 Hartman et al.
5,201,507 A * 4/1993 Tokuda ..... 271/9.01
5,573,234 A * 11/1996 Petocchi ..... 271/9.01
5,615,874 A 4/1997 Parthasarathy et al.
5,641,154 A * 6/1997 Gysling et al. ..... 271/9.01
5,810,346 A 9/1998 Jorg
6,015,148 A * 1/2000 Cho ..... 271/164
6,135,438 A * 10/2000 Newman et al. ..... 271/9.07
6,213,456 B1 4/2001 Hirano et al.
6,331,001 B1 * 12/2001 Sekiguchi ..... 271/9.01
6,366,827 B2 4/2002 Krasuski et al.
6,381,443 B1 4/2002 Kawata et al.
6,695,303 B2 * 2/2004 Okada et al. ..... 271/9.12
6,908,078 B2 6/2005 Suzuki et al.
7,027,765 B2 * 4/2006 Han ..... 399/391
7,451,972 B2 * 11/2008 Fukada et al. ..... 271/9.09
7,478,804 B2 * 1/2009 Yamada et al. ..... 271/9.09
2001/0032033 A1 10/2001 Krasuski et al.
2004/0061273 A1 4/2004 Yamada et al.
2006/0220296 A1 10/2006 Chapman et al.

* cited by examiner

MULTIMODE STACK AND SHINGLE DOCUMENT FEEDER

RELATED APPLICATIONS

The present application is a continuation of commonly owned, co pending U.S. patent application Ser. No. 11/267,003, filed Nov. 4, 2005, entitled "MULTIMODE STACK AND SHINGLE DOCUMENT FEEDER" in the names of James A. Fairweather, Thomas M. Lyga and Theresa Bartick that is hereby incorporated by reference in its entirety, which is a continuation-in-part of U.S. patent application of Thomas M. Lyga, Carl R. Chapman and James A. Fairweather, Ser. No. 11/084,233, filed Mar. 18, 2005 for PAPER HANDLING SYSTEM MATERIAL FEED PATH ARRANGEMENT and assigned to Pitney Bowes Inc. of Stamford, Conn., that is hereby incorporated by reference.

This application includes: partial common; inventorship, drawings, and detailed description; and common: and assignee with: U.S. application 11/267,389Publication Number 2007/0102865, for SHINGLE MODE MEDIA ITEM FEED ARRANGEMENT, filed Nov. 4, 2005, in the names of Theresa Bartick, Donald Surprise, Norman R. Lilly, James A. Fairweather; and 11/266,878U.S. Pat. No. 7,427,063, for SHINGLE MEDIA ITEM FEED TRAY WITH SPRING LOADED SELF LOCKING SLED, issued Sep. 23, 2008, in the names of James A. Fairweather, Donald Surprise, James A. Salomon, Norman R. Lilly and Thomas M. Lyga.

FIELD OF THE INVENTION

The present invention relates to paper handling systems, such as, printers, folders or inserter systems, and more particularly to a multimode stack and shingle document feeder.

BACKGROUND OF THE INVENTION

Various paper handling systems are designed to process a wide variety of media items. These media items may be of various sizes and shapes and of various types of materials and documents. For example, if the media items are envelopes, to accommodate and process a volume of items, the envelope may be shingled in a shingle feed tray. However, if the items are sheets, such as 8½×11 paper, to accommodate and process a volume of sheets, the items may be stacked in a stacks feed tray. When these media items are moved from the shingle or stacks feed tray into the feeder mechanism, as the case may be, the items are separated from the other media in the tray for processing in the system.

To obtain reliable media item separation in the separation operation, the input mechanism of existing media handling systems are limited to specific media geometry due to a number of compromises that must be made in the presentation of the media items to the feeder. The optimal presentation of the media to the separator is a complex problem that is constrained by the geometry of the media being fed, the form of separator, the desired form of human interaction with the system, the control of the stack force during feeding, and other factors.

In certain inserter products, for example, all media items are fed from a shingled stack of items. This is a logical set up and orientation for short media items such as ⅓ to ½ document length (such as 8½×11 inches) media items, including trifold media items, envelopes, and small booklets. The format is cumbersome for sheets, such as 8½×11 inch sheets of paper. The conflicting angles at which the various media (stacked sheets vs. shingled envelopes) advance down the tray can cause wide variations in stack normal force and compromise the feeder's ability to separate the media. Accordingly, separate input points with feeder mechanisms or the need for operator intervention to change the feeder mechanism for the type of feed tray, shingle or stacks, and the type of media, are frequently employed.

SUMMARY OF THE INVENTION

It is an object of the present invention to reduce the need for separate feeder input points for various types of media items.

It is another object of the present invention to provide a flexible feeder for separating and feeding a wide variety of media items from different types of feed trays.

It is a further object of the present invention to provide a single feeder mechanism which operates to separate and feed media items from a stacks or a shingle feed tray.

A feeder for feeding media items from a tray embodying the present invention includes a first nudger roller and a second nudger roller. The first and the second nudger roller are moveably mounted to the feeder. The first and the second nudger rollers are in a first position when a tray of a first type is connected to the feeder. The first and the second nudger rollers are in a second position when a tray of a second type is connected to the feeder.

In accordance with an embodiment of the present invention, a feeder for feeding media items from a detachable tray includes a first nudger roller and a second nudger roller. The first and the second nudger roller are moveably mounted to the feeder. The first and the second nudger rollers are in a first position when a shingles tray of media items is connected to the feeder such that the first and the second nudger rollers are positioned to each engage each media item in the shingles tray when each such media item is positioned in the shingles tray to exit the shingles tray and to be moved from the shingles tray into the feeder. The first and the second nudger rollers are in a second position when a stacks tray of media items is connected to the feeder such that the first nudger roller is positioned out of engagement with media items in the tray and said second nudger rollers is positioned to each engage each media item in the stacks tray when each such media item is positioned in the stacks tray to exit the stacks tray and to be moved from the stacks tray into the feeder.

In a feeder for feeding media items from a tray of a first type and a tray of a second type and having a first nudger roller and a second nudger roller, a method embodying the present invention includes the steps of moving the first and the second nudger rollers into a first position when the tray of a first type is connected to the feeder and moving the first and the second nudger rollers into a second position when the tray of the second type is connected to the feeder.

Another method embodying the present invention includes the steps of connecting a stacks feed tray to a feeder having a feed head assembly. Enabling the rotation of a the feedhead assembly over a first range of rotation by the connecting of the stacks feed tray to the feeder. Connecting a shingles feed tray to the feeder. Enabling the rotation of the feedhead assembly over a second range of rotation by the connecting of the shingles feed tray the feeder.

BRIEF DESCRIPTION OF THE DRAWINGS

Reference is now made the various figures wherein similar reference numerals designate similar items in the various views and in which.

DETAILED DESCRIPTION OF THE PREFERRED EMBODIMENT

Figure 1:
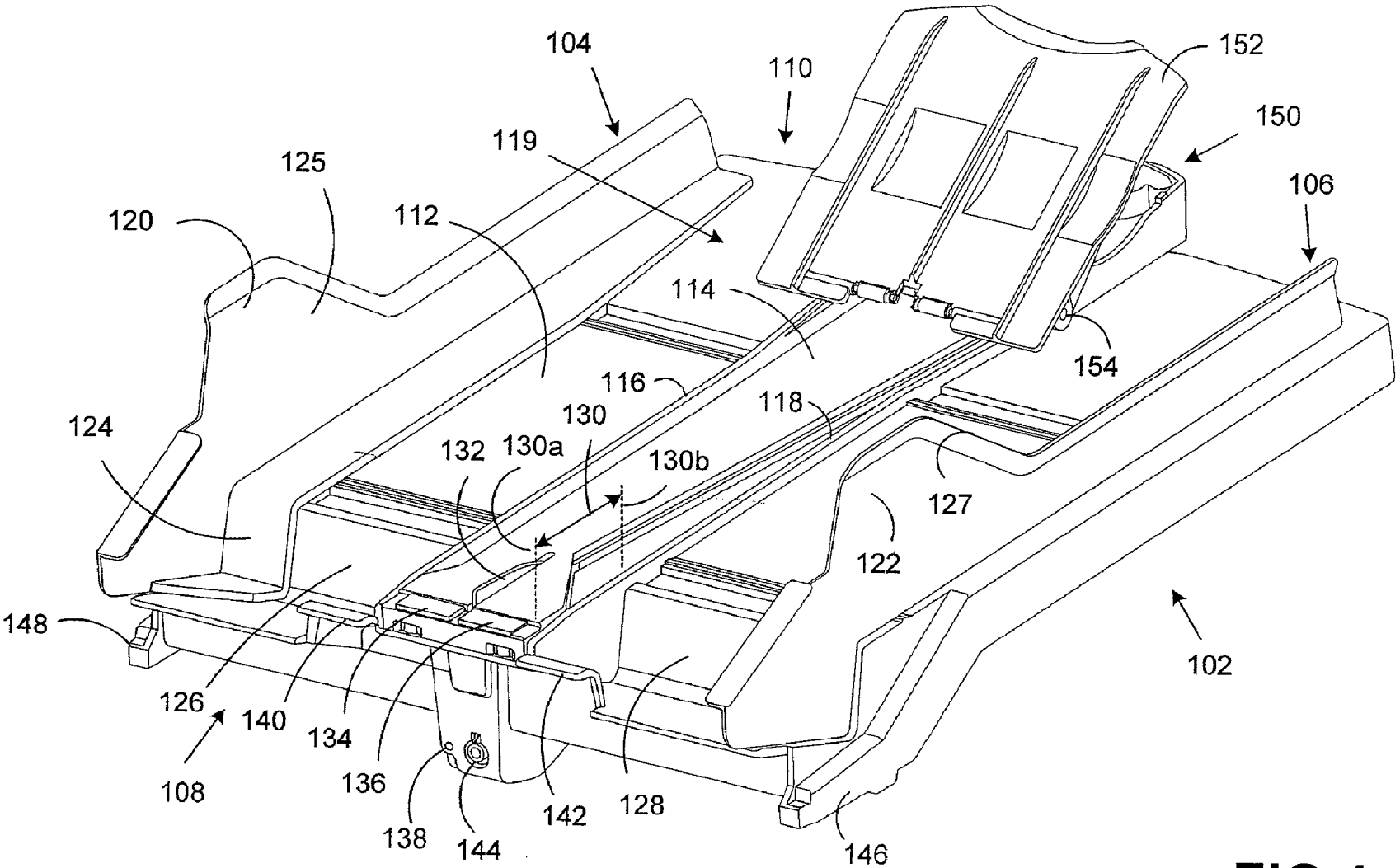
FIG. 1 is a perspective view of a shingle feed tray for media items embodying the present invention.
Figure 2:
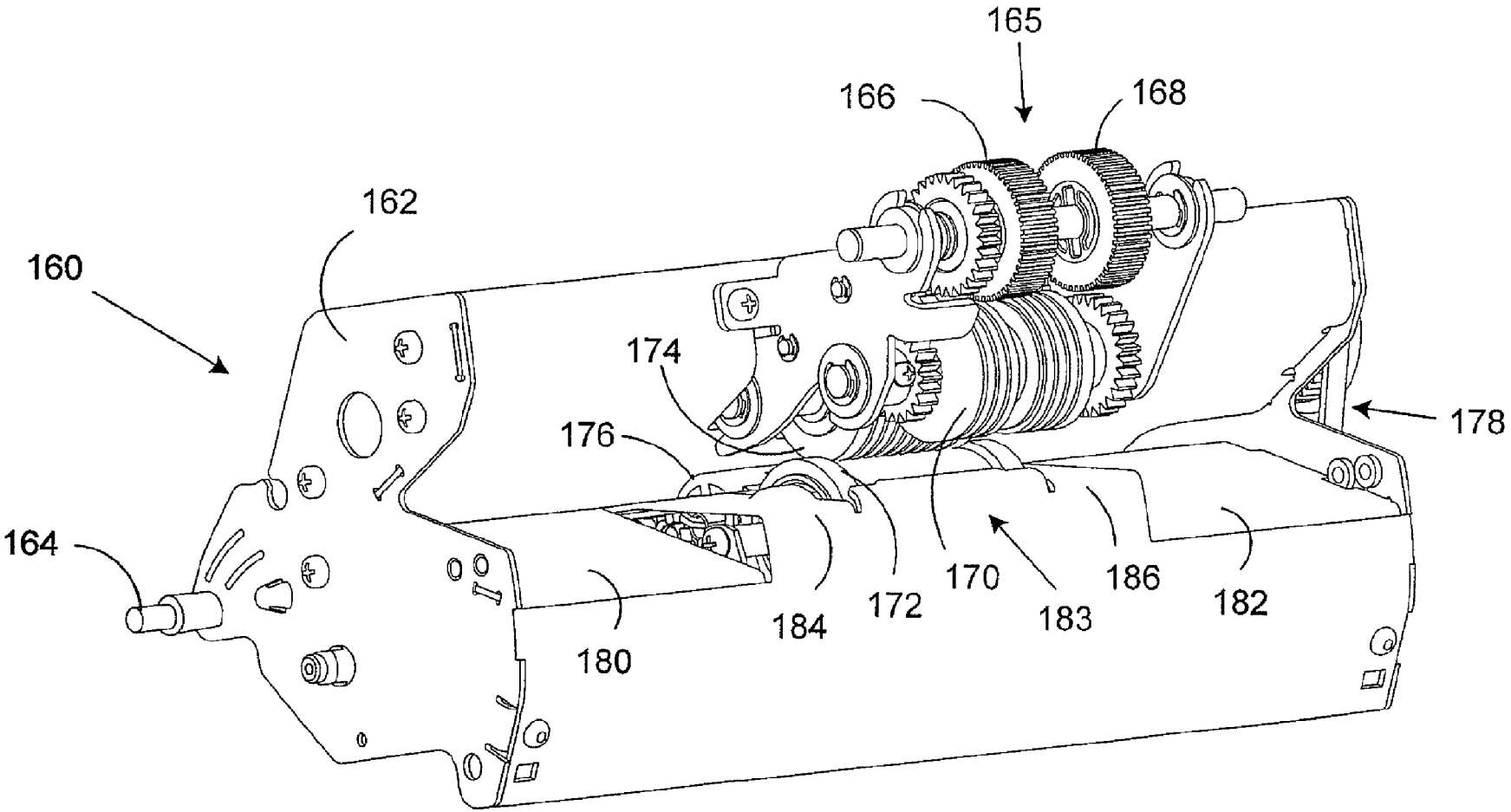
FIG. 2 is a perspective view of a portion of a feeder adapted to work in conjunction with the feed tray shown in FIG. 1 and embodying aspects of the present invention.
Figure 3:
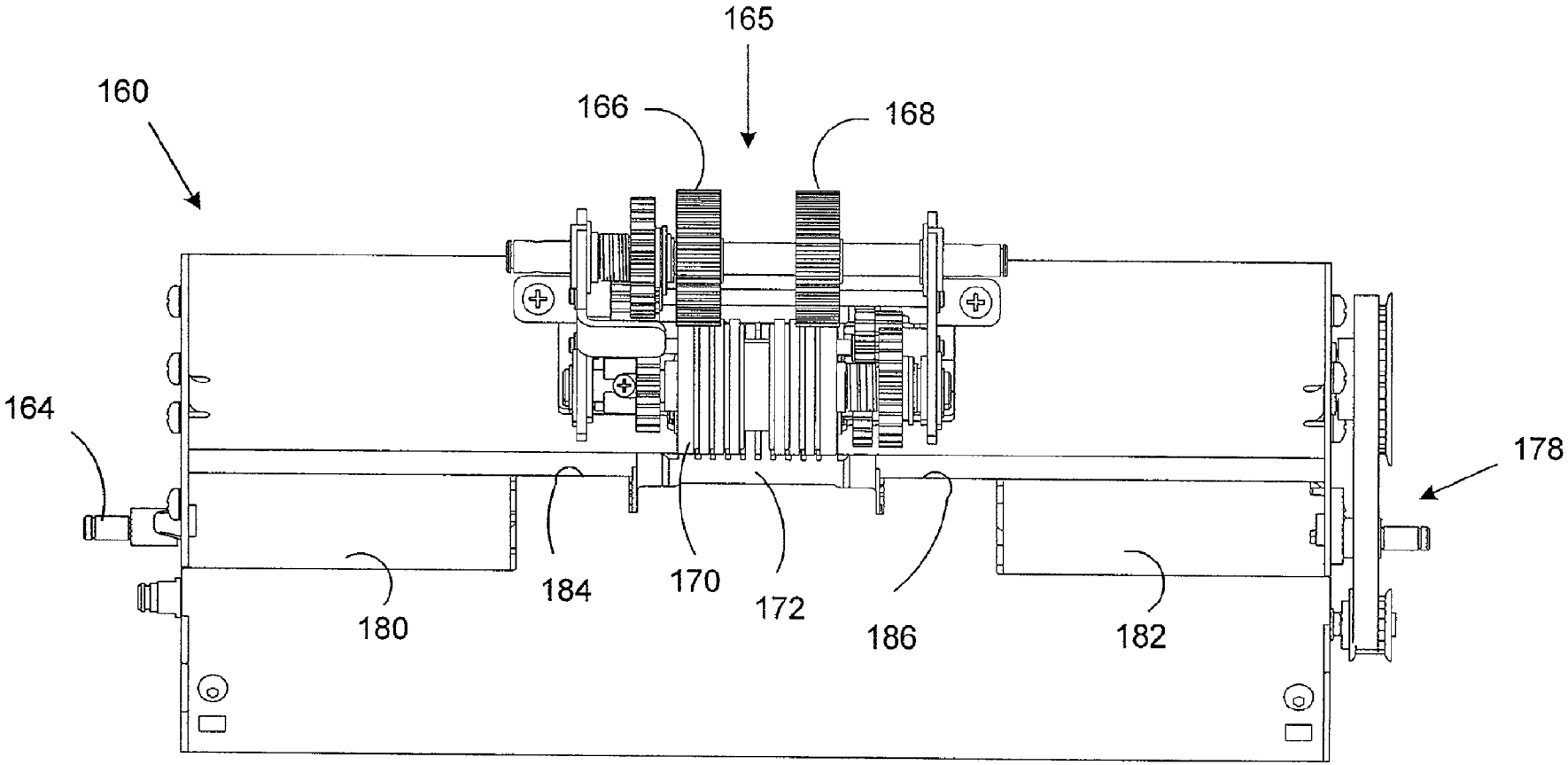
FIG. 3 is a front view of the feeder shown in FIG. 2.

Reference is now made to the various figures. A shingle media feed tray 102 includes moveable side guides 104 and 106 adapted to contact the edges of media items loaded into the tray. The side guides 104 and 106 help guide media items as they are moved toward the exit area 108 of the tray 102 from the rear area 110 of the tray 102. The tray includes a bottom surface 112 onto which are mounted a shaped rail such as tapered rail 114 and two support rails 116 and 118. The support rails 116 and 118 are designed to support the bottom edge of shingled media loaded into the shingle tray 102 and are higher, rising above the surface of the tapered sled rail 114. The rails 116 and 118 may have a thickness of 6 millimeters, however, the thickness of the rails is not critical. The rails are designed to support the media bottom edge and provide a low friction surface over which the material can be advance toward the feedhead.

The side guides 104 and 106 may be moved in and out of engagement with the sides of media items loaded into the shingle tray receptacle area 119 for a plurality of media items. The side guides 104 and 106 may be operated by any conventional mechanism or in the manner shown in U.S. patent application Ser. No. 11/123,617 filed on May 6, 2005 by James A. Solomon, Donald Surprise and Christopher D. Clarke entitled DETACHABLE FEED TRAY WITH SELF-ADJUSTING SIDE GUIDES and assigned to Pitney Bowes Inc.

The side guides 104 and 106 each engage the side edges of the media items along the entire length of each side guides. The area of the side guides 120 and 122 toward the exit area 102 are of a greater height than other the portions of the side guides. 104 and 106. This is to provide greater lateral guidance of the media item edges adjacent the exit area 108. The lower portions of the side guides 104 and 106 facilitate loading of media items into the tray. Side guide 106 is the mirror image of side guide 104, with section 122 as the mirror image of section 120

If desired for any particular application, the side guides 104 and 106 each may be dimensioned, in an alternate arrangement not shown, to have a section toward the exit area 108 of the tray which does not engage the side edges of media items. In such alternative arrangement, the sections of the side guide 120 and 122 would be modified and configured to be out of engagement with media item side edges adjacent the exit area 108.

The side guides 104 and 106 as shown in the various figures include a section 124 shown on side guide 104 and a section 125 on side guide 106 that drop away from and are below the surface of rails 116 and 118 and surface 112 of the tray. This forms two cavity areas shown generally at 126 and 128, toward the front area 108 of the tray 102. In this area of the tray 102, media items moving toward the exit area 108 of the shingle tray are supported on the bottom edge solely on the support rails 116 and 118. Accordingly, in this area, media items such as envelopes, which have four edges are supported in the tray on their bottom edge solely by the support rails 116 and 118. The area of the tray where the bottom edge the media items is supported by and engaged by the two support rails 116 and 118 is denoted by the line 130 with two arrow heads. The side edges the media items are guided by the tray 102 by side guides 104 and 106. Additional support for the media items are from adjacent media items with the last media item to exit the tray 102 having additional support from sled 150.

Line 130 denotes the length of the support rails 116 and 118 between the front of the support rails (arrow head 130*a*) and the surface 125 of side guide 104 (arrow head 130*b*). Arrow heads 130*a* and 130*b* touch the dashed lines, signifying, respectively, the front of the rails 116 and 118 and surface 125. The corresponding surface for guide 106 is surface 127. The media items thus exit the tray 102 supported by rails 116 and 118 as they pass through the cavity areas 126 and 128 into a feeder or other mechanism. The length of the support rails 116 and 118 denoted by line 130 is 60 millimeters. However, the length is a matter of design choice and involves tradeoffs between the specified capacity of the feeder, the maximum acceptable height of the tray above the working surface, and the overall specification of system. The length of the support rails 130 is also involves a compromise between the desire for structural integrity, and the need to create cavity areas 126 and 128 of sufficient size as to accommodate shingle material having imperfections such as curl, corner deformations, and irregular cross-sections that may result in uneven bending.

The tray 102 includes an out of media sensor 132 and two rubber pads 134 and 136 at the edge of the exit area 108 of the tray 102. The rubber pads 134 and 136 help with the singulation of media as the media is moved into the feeder. A magnet 138 is provided to cooperate with a mechanism in the feeder so that the feeder can sense the type of feed tray inserted into the feeder, here shingle-type feed tray 102. The shingle feed tray 102 includes two up-stop tabs 140 and 142, which cooperate with a feeder nudger roller mechanisms to properly position the feeder feedhead assembly 160, and thus the nudger rollers 166 and 170, with respect to the media items in the feed tray. A second magnet 144 cooperates with the out of media items sensor 132 to provide information to the feeder regarding the status of the feed tray. Arms 146 and 148 are operable to engage with the feeder mechanism to position and lock the shingle tray 102 into proper position with respect to the feeder.

The shingle tray 102 includes a spring-driven sled 150 which is mounted to the tapered sled rail 114. The sled 150 includes a handle 152 which is collapsible to pivot around the pivot 154. The handle 152 can be operated to rotate down toward the bottom surface 112 of the tray 102. The positioning of the handle 152 adjacent to the tray surface 112 facilitates loading of media items into the tray receptacle area 119. Different volumes of shingled media items may be loaded into the tray receptacle area 119 and the sled 150 moved to engage the last media item loaded into receptacle area 119.

A feeder 183 includes a feed head assembly 160 having a frame 162 which is adapted to rotate around a pivot 164. The frame 162 and thus feed head assembly 160 rotate around the pivot 164 into the appropriate position when a shingle or a stack feed tray is engaged with the feeder mechanism. The pivot 164 is connected to a frame 207 which provides the ground or base for the pivot 164 around which the feed head assembly 160 rotates. The feed head assembly 160 includes an upper nudger roller 165 having two nudger roller elements 166 and 168 and a lower nudger roller 170 having a series of ribbed surfaces. The two nudger roller elements 166 and 168 are positioned equidistant from the center line of the path of movement of media items from the shingle feed tray 102. Various types of nudger roller arrangements may be employed. For example, the upper nudger roller may be a single element nudger roller and the lower nudger roller can have three nudger roller elements. Selection of the height and width of each nudger assembly is done with the goals of minimizing skew, and controlling the attitude of the approaching shingled stack. The assembly 160 also includes a separator roller 172, which cooperates with a feed roller 174. A take-away roller 176 is also provided. The drive to the various rollers is provided by a belt drive system 178.

The feed head assembly 160 includes two recessed areas 180 and 182. When a shingle media tray is engaged with the feed head assembly 160, the media items are supported on rails 116 and 118, as shown in FIG. 1, until the media is moved into operative engagement with the separator roller 172 and the feed roller 174. In this manner, the media items being transitioned from the shingle tray 102 into the feed head assembly 160 are not caused to skew by any forces on the edges of the media items due to either friction with the portions of the shingle tray or friction with portions of the feed mechanism. Bending of the media item does not occur until the media item is fully captured between the separator roller 172 and feed roller 174. The front of the feeder 183 includes two up-stop feeder contact surfaces 184 and 186. These feeder contact surfaces cooperate with and are engaged with the two up-stop tabs 140 and 142 of the shingle feed tray 102.

Figure 4:
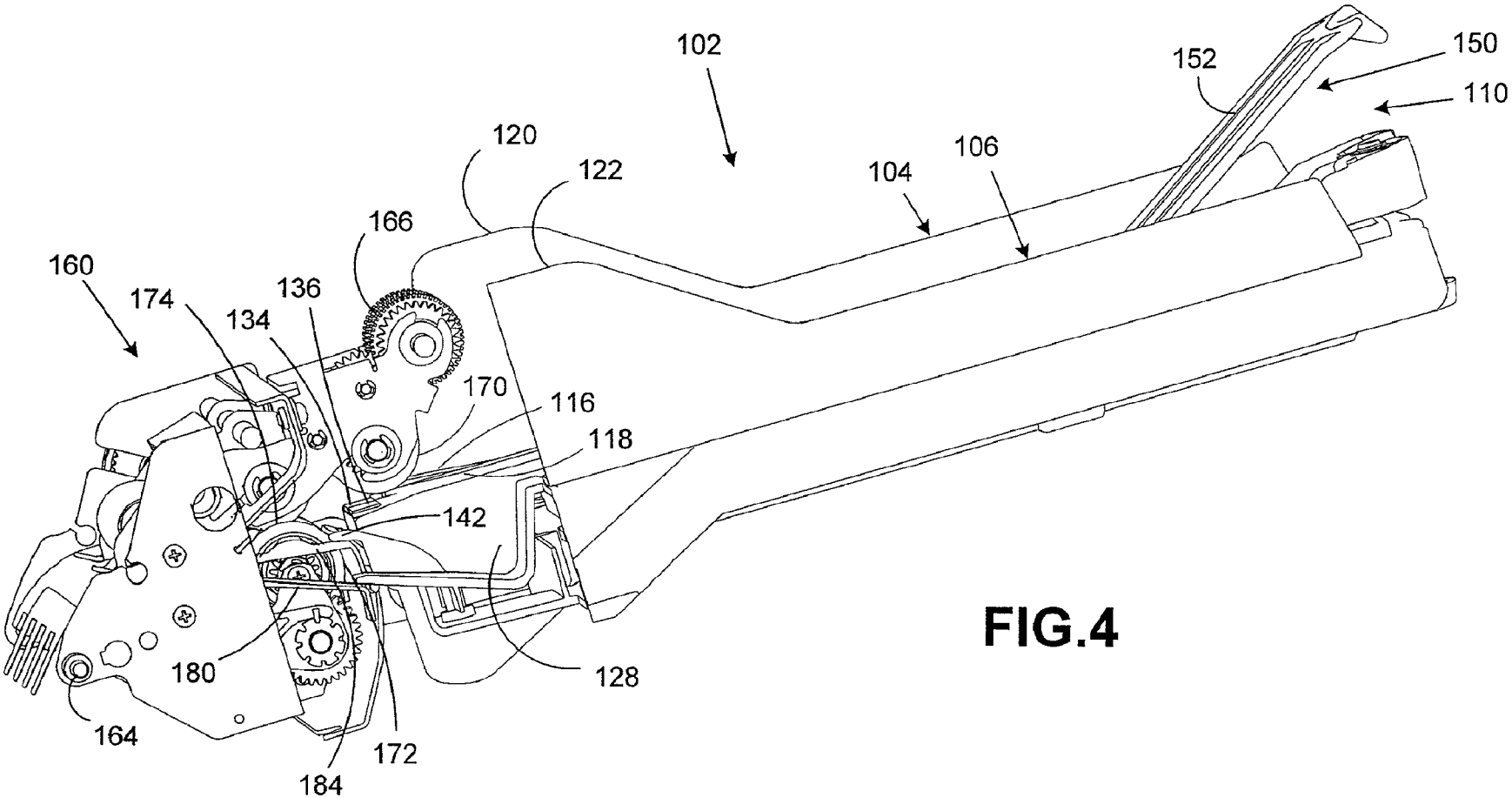
FIG. 4 is a cut away perspective side view of the shingle feed tray shown in FIG. 1 connected to the feeder shown in FIGS. 2 and 3 illustrating how the shingle feed tray engages and operates in conjunction with the feeder.

As is shown in FIG. 4, the tray 102 up-stop tab 142 engages the sheet metal portion 184 to lock and limit the upward or counterclockwise rotation of the feed head assembly 160 around the pivot 164 to a minimal rotation for feeding shingled media items. This minimal rotation is not related to the volume of shingled media items in shingle feed tray 102. The stops cooperate to position the nudger rollers 165 and 170 to be properly oriented so that both nudger rollers engage shingled media items exiting the feed tray 102 as they are moved on the support rail 118 and the support rail 116 (not shown in FIG. 4) into operative engagement with the separator roller 172 and the feed roller 174.

Figure 5:
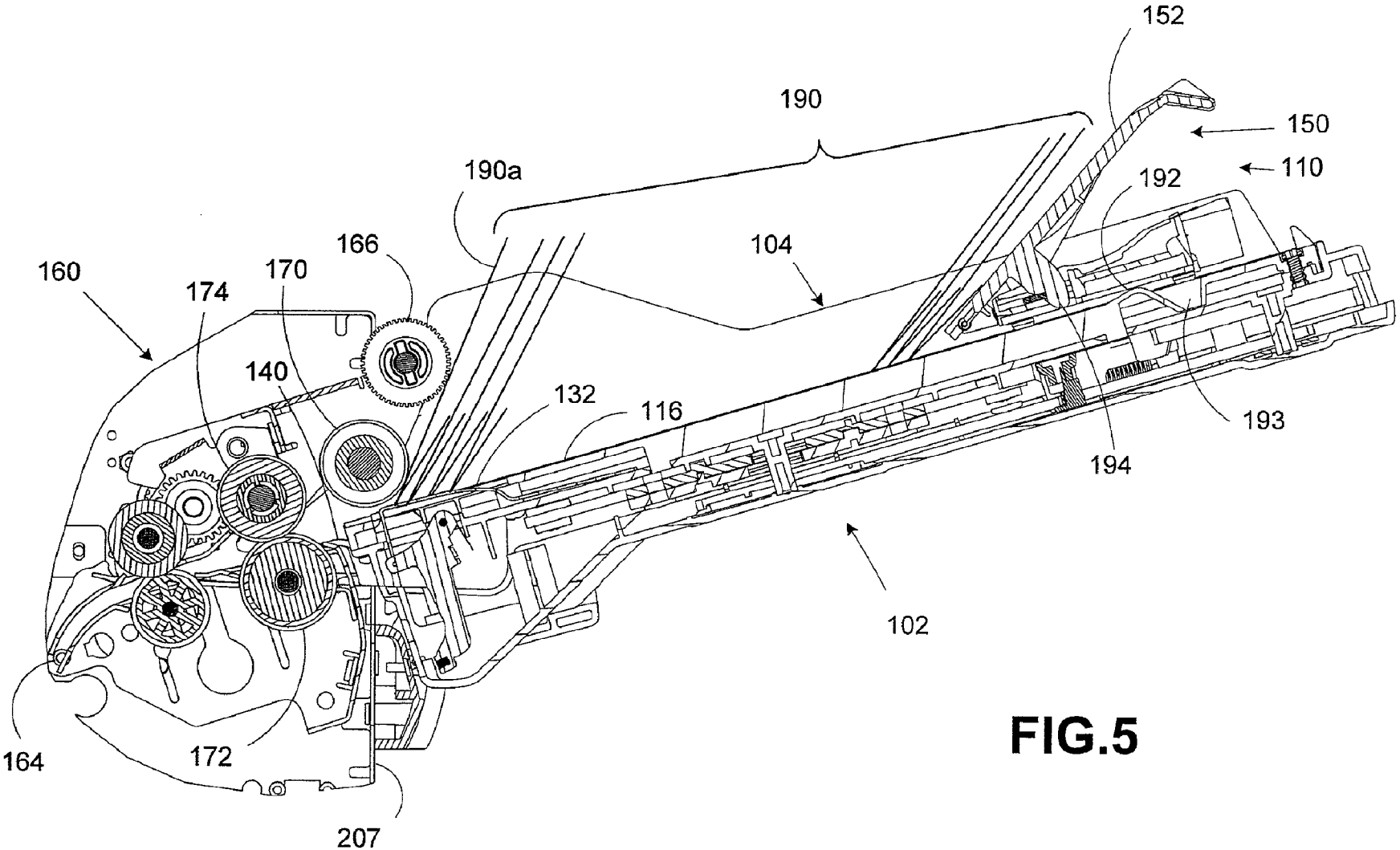
FIG. 5 and FIG. 6 are side views of the mechanism shown in FIG. 4, with different volumes of shingled media in the shingle feed tray.
Figure 6:
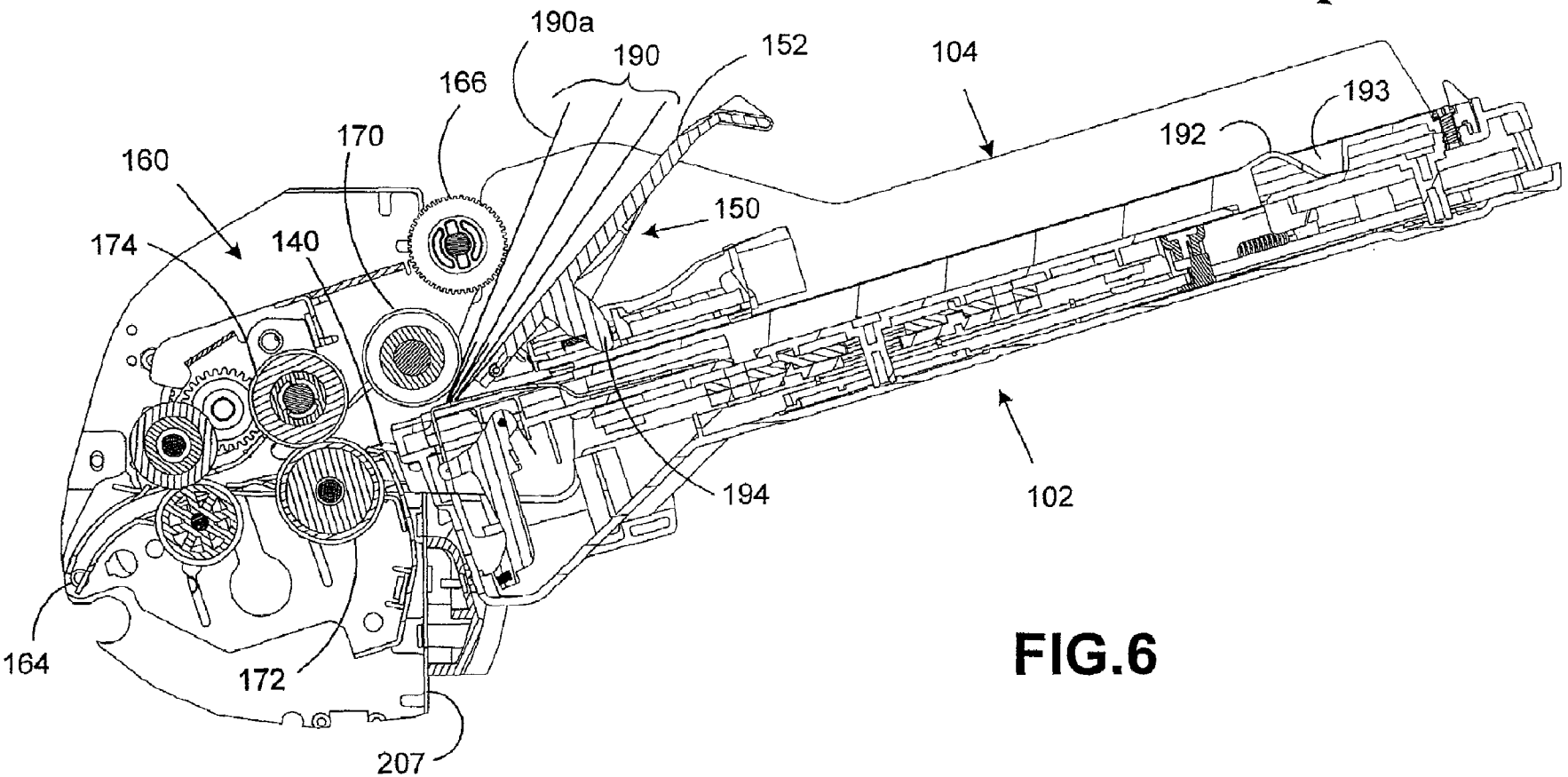

A shingled stack of media items shown as envelopes 190, as shown in FIGS. 5 and 6, are loaded into the shingle feed tray 102. The surface of the handle 152 engages the rearmost envelope in the shingled stack. The two nudger rollers 166 and 170 are shown engaging the envelope in the stack 190 closest to the exit point of the tray. The envelope 190*a* will be moved under the pressure of the spring loaded sled 150 and the operation of the nudger rollers 166 and 170 along the support rail 116 and support rail 118 (not shown in FIG. 5) into operative engagement with the separator roller 172 and the feed roller 174.

A cam surface 192 in the lower surface of the tray 102 cooperates with a cam follower locking tab projection 194 attached to the handle of 152 of the sled 150. The function of the cam 192 is to ensure that the handle is cammed to the position shown where it is positioned to support shingled media items as the sled is moved toward the front of the tray 102. Accordingly, after the media items are loaded into the tray 102 with the handle in the collapsed position, as the sled is moved toward the media exit end of the tray, the handle 152 is caused to rotate in a counterclockwise direction to be properly positioned to support the shingle media in the correct orientation for cooperation with the feed head assembly 160 and, more specifically, the feeder nudger rollers 165 and 170.

The stack of media items 190 is smaller, as shown in FIG. 6, than the stack of media items shown in FIG. 5. Accordingly, in FIG. 6, the sled 150 is located closer to the exit area of the shingle feed tray as compared to FIG. 5. The sled 150 and the energy stored in the sled spring (not shown in FIG. 6) has been employed to help move the media items into the feed head assembly 160.

Figure 7:
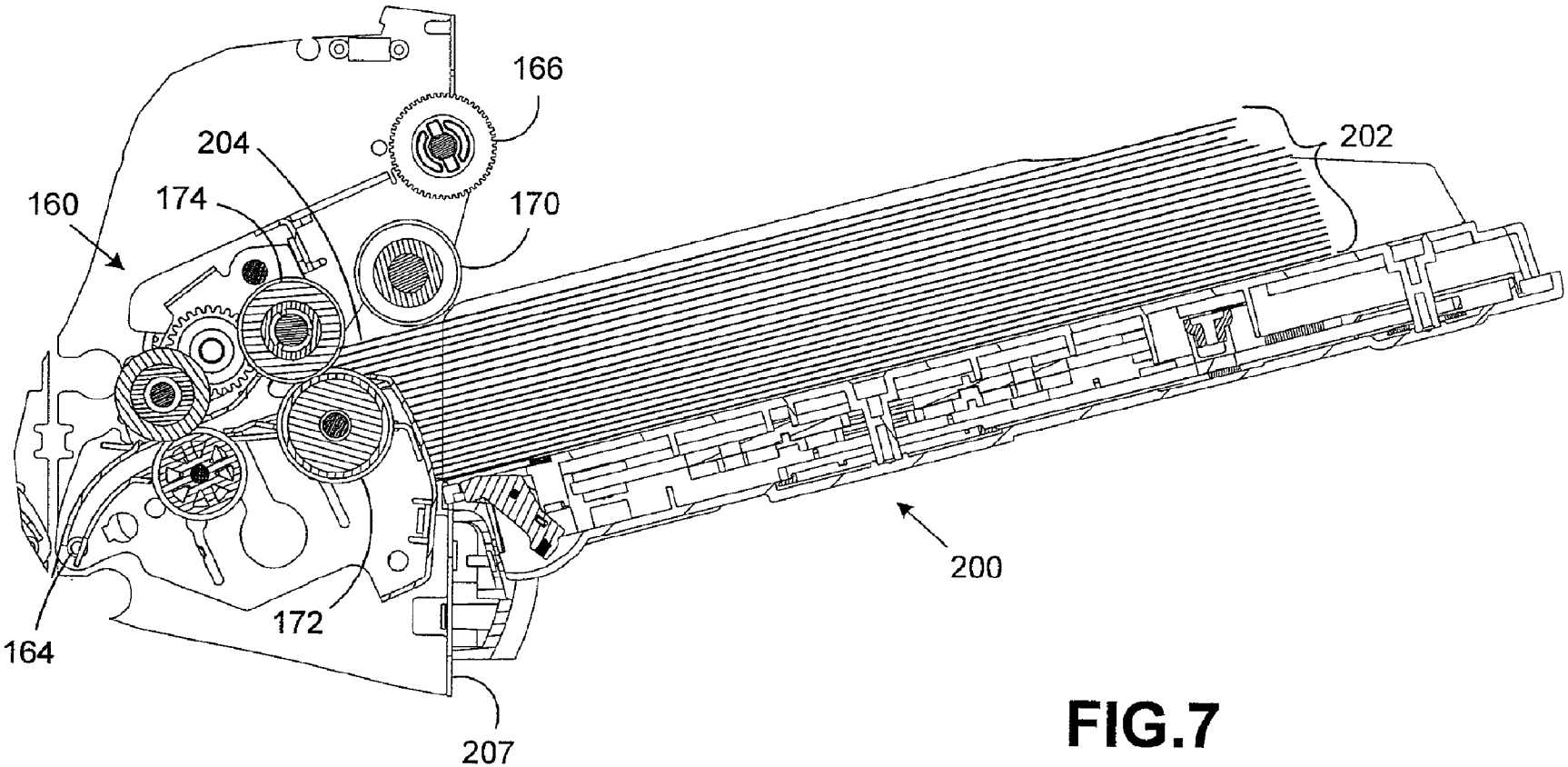
FIG. 7 and FIG. 8 are side views of a stacks media feed tray connected to the feeder shown in FIGS. 2 and 3, illustrating how the stacks feed tray engages and operates in conjunction with engaging the feeder and with different volumes of stacked media in the stacks feed tray; and, FIG. 9 is a diagrammatic view of a feeder system with a common media feed arrangement having detachable stacks and shingle feed trays and employing feeders of the type shown in FIGS. 2 and 3.
Figure 8:
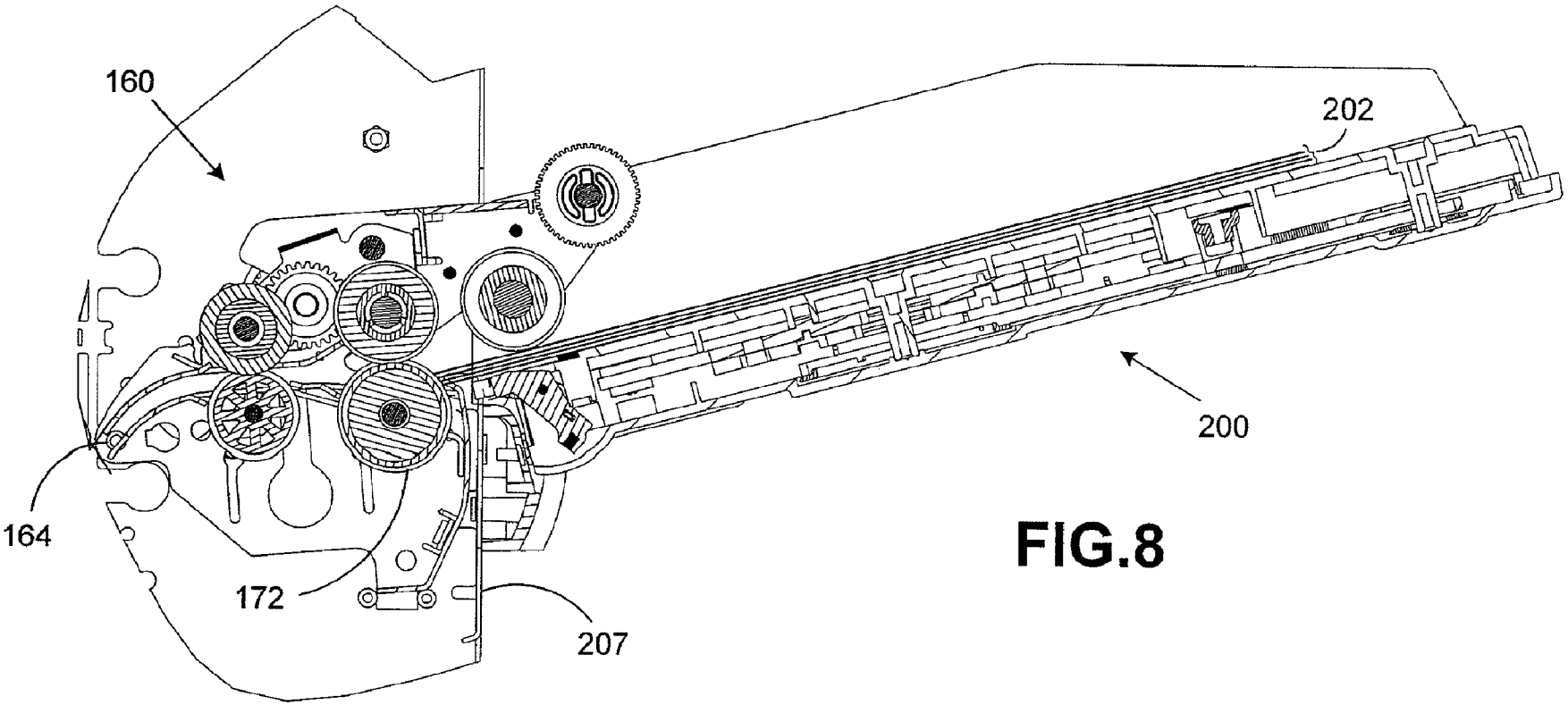

A stacks feed tray 200 shown in FIGS. 7 and 8 is connected to the feed head assembly 160. The top-most item of the stack of media items 202 is in engagement with only the lower nudger roller 170. With the stacks feed tray 200 connected into the feed head assembly 160, the feed head assembly is pivoted such that the upper nudger roller 166 does not engage the stacked media items 202. A top group of the stacked media items shown at 204 has been moved forward in the stack and is shown engaging the separator roller 172 and its associated feed roller 174 to singulate the media items out of the stacks feed tray 200 and into the feeder 183.

The stacks feed tray 200 is connected to the outer frame 206 of the feeder 183 and does not lock or prevent the feed head assembly 160 from pivoting around the pivot 164 as is the case with shingle feed tray 102 where only a minimal rotation is enabled and which is not related to the volume of shingled media items in tray 102. The feed head assembly pivots due to the weight of the feed head assembly 160. The position of the feed head assembly 160 depends upon the amount of media items 202 in the stacks feed tray 200 and its relationship to the lower nudger roller 170. As media is singulated and fed into the feeder, the volume of the media item stack 202 is reduced. As is shown in FIG. 8, the feed head assembly 160 rotates in a clockwise direction such that the lower nudger roller 170 remains in appropriate contact with the top most media item in the stack of media items 202. This also provides support for the stacks feed tray 200, which locks into place by means of a locking mechanism (not shown). Any suitable tray locking mechanism may be employed, such as the system similar to arms 146 and 148 of the shingle feed tray.

As can be seen from the various figures, the feed head assembly is free to move in a rotational direction as the stack of media items from the stacks feed tray 200 is depleted. In contrast, the feed head assembly 160 is not free to rotate when a shingle feed tray, such as tray 102, is connected to the feed head assembly. In such case, the feed head assembly 160 is locked from rotation in a pre-determined position with only minimal rotation for feeding enabled by the two up-stop tabs 140 and 142 in cooperation with the feeder contact surfaces 184 and 186. This minimal feed head assembly 160 rotation is to provide the gap for shingled media items to be fed out of the shingle feed tray 102.

The shingle feed tray 102, when engaged with the feeder 183, as is shown in FIGS. 4, 5 and 6, provides approximately a 4 mm gap for shingled media items to be fed out of the shingle feed tray 102. The particular gap size is a matter of design choice. The gap is provided for a shingled media item to move under the nudger roller 170 and into the nip of the separator roller 174 and feed roller 172. The movement of the feed head assembly along this small gap is limited in its clockwise direction by the engagement of the two up-stop tabs 140 and 142 and the two contact surfaces 172 and 186. The clockwise rotation is limited by the interference of the nudger roller 170 and the surface of the shingle feed tray tapered sled rail 114. When the media items have been depleted or are otherwise not in the shingle feed tray 102, the lower nudger roller 170 rests on the portion of the tapered rail adjacent to the out of paper sensor 132. The two tapered rails slope downward below the tapered sled rail. The tapering of the rails brings the lead edge of the advancing material into direct contact with the tapered sled rail and the two retard pads 134 and 136. The contact initiated with the retard pads 134 and 136 acts as a secondary separation mechanism that reduces the propensity of the feed system to present a multitude of shingled elements to the separation system.

The first and second nudgers 166 and 170 are mounted with a fixed relationship to the feeder 183. The system is arranged such that the feedhead assembly 160 is in a fixed position when the shingle tray 102 is connected to the feeder 183. The feedhead assembly 160 is free to rotate through a multitude of positions when the stacks tray 200 is connected to the feeder 183. The nudgers 166 and 170 are rigidly mounted to the feeder 183, and the communication between the tray and feedhead assembly 160 sets the appropriate relationship between the nudgers 166 and 170 and the media. The feedhead assembly 160 pivots freely when the stacks tray 200 is fitted to the feeder 183, and is constrained to a very small rotation when the shingle tray 102 is fitted to the feeder 183. With the shingle tray 102 fit, the nudgers 166 and 170 to tray relationship is determined by the fixed geometry of the feedhead assembly 160 and the relationship between the tray and the feedhead assembly 160. Other arrangements for mounting the nudger rollers can be employed. For example, the nudgers can be mounted so that they move independently of the feedhead assembly 160.

Figure 9:
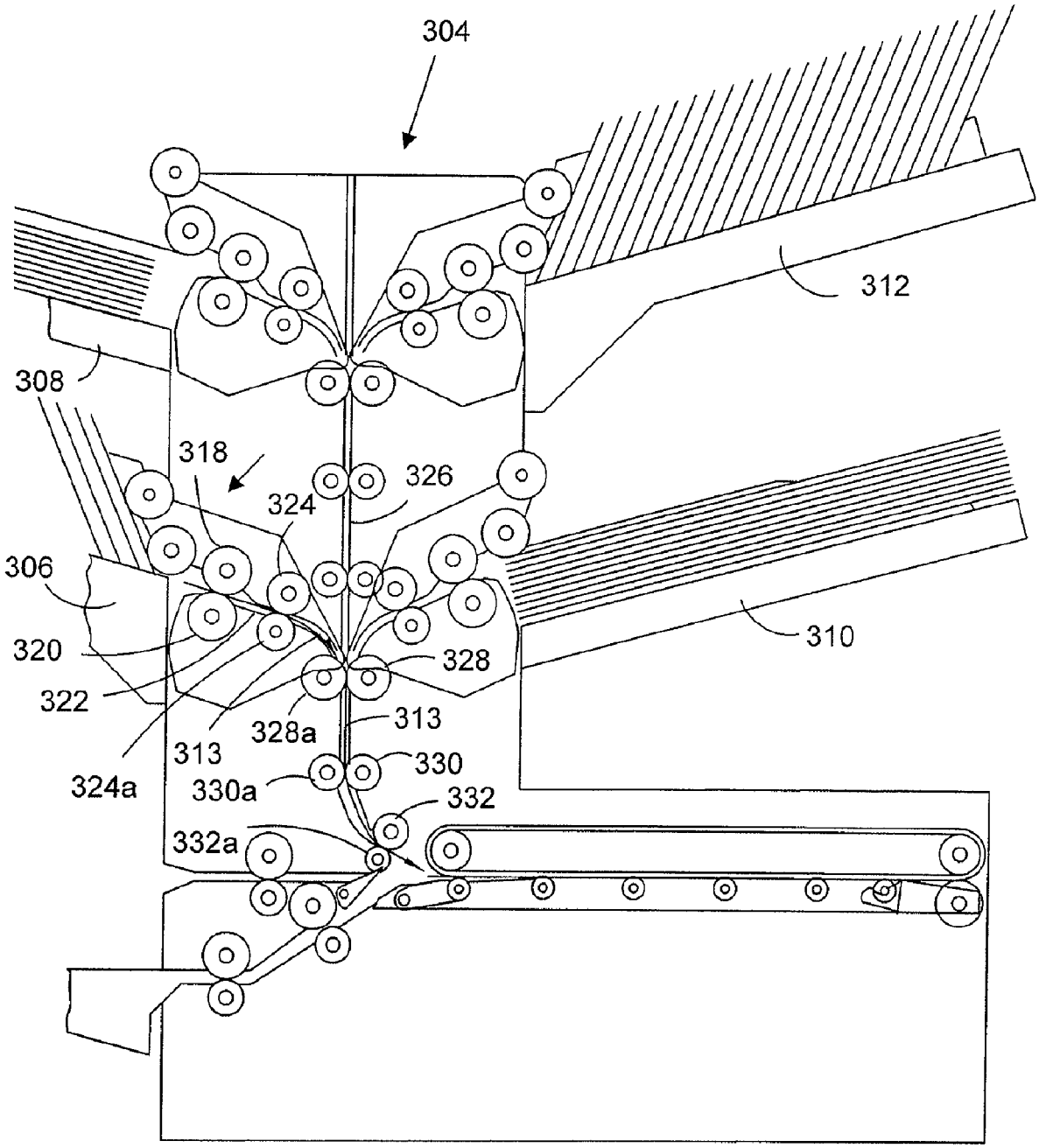

Reference is now made to FIG. 9. A folder inserter system includes vertical tower feed station 304 with a common material feed area. The system employs feeders and shingle and stacks feed trays of the type shown in the various figures. The tower feed station 304 provides a common feed area having detachable feed trays and associated feed mechanisms. The feed station 304 includes four separate detachable feed trays 306, 308, 310 and 312 for envelopes, sheets and inserts. Detachable feed tray 306 is a shingle envelope feed tray. Detachable feed tray 308 is a stacks sheet feed tray. Detachable feed tray 310 is a stacks sheet feed tray. Detach able feed tray 312 is a shingle insert feed tray. Various numbers and types of detachable feed trays and associated feeder mechanism can be included in the vertical tower feed station 304.

Although the detachable feed trays show in FIG. 9 are shown as having envelopes, sheets and inserts, each of these feed trays can feed other types of media, which can be loaded (depending on the feed tray type) in a stacks or shingle orientation depending on the media involved. Thus, many types of material or media can be fed by any feed station mechanism. The materials or media can be, for example, pamphlets, brochures, return envelopes, cards, booklets, slips and checks. Identical feed mechanisms are shown for each of the four feeders 306, 308, 310 and 312.

Each of the four feeder mechanisms, such as feeder 314, includes a feed head mechanism in the vertical tower and an associated detachable feed tray such as detachable feed tray 306. The mechanisms in the vertical tower for each of the feeders are identical in structure, as previously noted. The media (for example envelopes) in the detachable feed tray 306 are fed from the tray by the singulator arrangement including a drive roller 318 and retard roller 320. The media is fed from the tray, as depicted by line 313, along the feed head exit guide 322 by take away rollers 324 and associated idler roller 324*a* to a vertical common feed path 326 by the tower drive rollers 328, 330, and 332, with their associated idler rollers respectively 328*a*, 330*a*, and 332*a*. As the media exits the vertical tower transport path 326, it may be moved onto various media item processing subsystems.

The term media item is intended herein to be a broad term and to include mail pieces such as various types of mail pieces such as letter mail, postcards and flats. The United States Postal Service (USPS) considers mail pieces to be flats when the mail piece exceeds at least one of the dimensional regulations of letter-sized mail (e.g. over 11.5 inches long, over 6⅛ inches tall, or over ¼ inch thick) but does not exceed 15¾ inches by 12 inches by 1¼ inch thick. Flats include such mail as pamphlets, annual reports and the like. Other examples of media items include sheets of paper, checks, booklets, slips, cards, envelopes, packages of greeting cards, and any other items that can be fed from a shingle or stacks type feed tray. Accordingly, while the detailed description is directed to the processing envelopes, any other suitable media items can be substituted for such media items in the description. Additionally, different types and arrangements of nudger rollers may be employed as well as pivoting and latching mechanisms for the rollers or for the feed head assembly and trays. Other configurations may be employed where the nudgers rollers move and/or pivot, under action from the feed trays or other means, to create the appropriate geometric relationship between the media being fed out and the nudger rollers. Various arrangements of feed and separator rollers or drives may be employed for feeding and separating the media from the stack of media items in the trays. Moreover, the feedhead assembly can have various configurations and combinations of rollers types to accommodate various applications and equipment arrangements. In addition, elevator tray mechanisms may be arranged with the feedhead to form a productive feed system as in high capacity media item feeder implementations.

While the present invention has been described in connection with what is presently considered to be the most practical and preferred embodiments, it is to be understood that the invention is not limited to the disclosed embodiment, but, on the contrary, is intended to cover various modifications and equivalent arrangements included within the spirit and scope of the appended claims.

What is claimed is:

1. A system for feeding media items comprising:

a frame;

a feed head assembly including a first nudger roller, a second nudger roller, and a separator device, the feed head assembly mounted to the frame for pivotal movement;

a first feed tray;

a second feed tray; and wherein at times when the feed head assembly is connected to the first feed tray the feed head assembly pivots into a first feed position to permit feeding of media items in the first feed tray into the separator device and at times when the feed head assembly is connected to the second feed tray the feed head assembly pivots into a second feed position to permit feeding of media items in the second feed tray into the separator.

2. A system as recited in claim 1, wherein the first position is different than the second position.

3. A system as recited in claim 2, wherein the first feed tray is a shingles feed tray whereby media items in the first feed tray are in a shingled arrangement.

4. A system as recited in claim 3, wherein the second feed tray is a stacks feed tray whereby media items in the second feed tray are in a stacked arrangement.

5. A system as recited by claim 1, wherein the first feed tray has a step-up tab and the feed head assembly has a corresponding contact surface such that the positioning of the step-up tab and the corresponding contact surface limit the pivotal movement of the feed head assembly at times when the first feed tray is connected to the feed head assembly.

6. A system as recited in claim 1, wherein the feed head assembly further includes a take-away roller.

7. A system as recited in claim 1, wherein when said feed head assembly is in the first feed position the first and second nudger rollers feed media items out of the first feed tray into the separator device.

8. A system as recited in claim 7, wherein when said feed head assembly is in the second feed position only the second nudger roller feeds media items out of the second feed tray into the separator device.

9. A method comprising:

connecting a first feed tray to a feed head assembly having first and second nudger rollers and a separator device thereby causing the feed head assembly to pivot into a first position wherein the feed head assembly feeds media items out of the first feed tray and into the separator device;

disconnecting and removing the first feed tray from the feed head assembly; and connecting a second feed tray to the feed head assembly thereby causing the feed head assembly to pivot into a second position wherein the feed head assembly feeds media items out of the second feed tray and into the separator device.

10. A method as recited in claim 9, wherein the first position is different than the second position.

11. A method as recited in claim 10, wherein the first feed tray is a shingles feed tray whereby media items in the first feed tray are in a shingled arrangement.

12. A method as recited in claim 11, wherein the second feed tray is a stacks feed tray whereby media items in the second feed tray are in a stacked arrangement.

13. A method as recited in claim 9, wherein the first feed tray has a step-up tab and the feed head assembly has a corresponding contact surface such that the positioning of the step-up tab and the corresponding contact surface limit the pivotal movement of the feed head assembly at times when the first feed tray is connected to the feed head assembly.

14. A method as recited in claim 9, wherein the feed head assembly further includes a take-away roller.

15. A method as recited in claim 9, wherein when said feed head assembly is in the first feed position the first and second nudger rollers feed media items out of the first feed tray into the separator device.

16. A method as recited in claim 15, wherein when said feed head assembly is in the second feed position only the second nudger roller feeds media items out of the second feed tray into the separator device.

* * * * *